US009262979B2

(12) United States Patent
Kim et al.

(10) Patent No.: US 9,262,979 B2
(45) Date of Patent: Feb. 16, 2016

(54) DISPLAY DEVICE AND METHOD FOR CORRECTING GAMMA DEVIATION

(71) Applicant: Samsung Display Co., Ltd., Yongin, Gyeonggi-Do (KR)

(72) Inventors: Ho In Kim, Seoul (KR); Kyung Won Kang, Cheonan-si (KR); Young-Sun Kwak, Cheonan-si (KR); Sang An Kwon, Bucheon-si (KR); Hyeon-Do Park, Anyang-si (KR); Won Jin Seo, Seoul (KR); Myung Bo Sim, Chungcheongnam-do (KR); Yoon Seop Shim, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 137 days.

(21) Appl. No.: 14/219,708

(22) Filed: Mar. 19, 2014

(65) Prior Publication Data

US 2015/0091949 A1 Apr. 2, 2015

(30) Foreign Application Priority Data

Oct. 1, 2013 (KR) ..... 10-2013-0117364

(51) Int. Cl.
*G09G 3/36* (2006.01)

(52) U.S. Cl.
CPC ..... *G09G 3/3648* (2013.01); *G09G 2320/0285* (2013.01); *G09G 2320/0673* (2013.01)

(58) Field of Classification Search
CPC ..... G09G 2300/026; G09G 2320/0233; G09G 2320/0626; G09G 2320/0276; G09G 2320/0693; G09G 2320/0271; G09G 2320/0285; G09G 2320/0673; G06F 3/1446; G06F 1/1647; G06F 3/1423
See application file for complete search history.

(56) References Cited

U.S. PATENT DOCUMENTS

2007/0229420 A1* 10/2007 Hwang ..... G09G 3/006 345/87
2007/0247408 A1* 10/2007 Nishimura ..... G09G 3/3688 345/89
2008/0252628 A1* 10/2008 Han ..... G09G 5/10 345/207
2010/0231616 A1* 9/2010 Park ..... G09G 3/22 345/690
2012/0169780 A1 7/2012 Park et al.
2013/0021390 A1 1/2013 Inada

FOREIGN PATENT DOCUMENTS

KR 10-2007-0099800 10/2007
KR 10-2008-0061913 7/2008
KR 10-2008-0067843 7/2008

(Continued)

*Primary Examiner* — Kumar Patel
*Assistant Examiner* — Afroza Chowdhury
(74) *Attorney, Agent, or Firm* — Innovation Counsel LLP

(57) ABSTRACT

A display device may include a display panel that includes a first region and a second region. The display device may include a controller that may receive a first gamma value and a second gamma value, use the first gamma value or a third gamma value to generate first image data, use the first gamma value and the second gamma value to generate a fourth gamma value, and use the fourth gamma value to generate second image data. The display device may include a data driver that may use the first image data and the second image data to generate a first data voltage set and a second data voltage set. The first region may use the first data voltage set to display a first portion of an image. The second region may use the second data voltage set to display a second portion of the image.

20 Claims, 8 Drawing Sheets

(56) References Cited

FOREIGN PATENT DOCUMENTS

| | | |
|---|---|---|
| KR | 10-2009-0114672 | 11/2009 |
| KR | 10-2011-0075476 | 6/2011 |
| KR | 10-2012-0041867 | 5/2012 |
| KR | 10-2012-0072724 | 7/2012 |

* cited by examiner

FIG.7

| In case where section of left region ranges from gray scale 20 to gray scale 60 | |
|---|---|
| reference value-(gamma value of center region-gamma value of left region) | select |
| 0 ~ 0.01 | use LUT1 |
| 0.011 ~ 0.02 | |
| 0.021 ~ 0.03 | use LUT2 |
| 0.031 ~ 0.04 | |
| -0 ~ -0.01 | use LUT3 |
| -0.011 ~ -0.02 | |
| -0.021 ~ -0.03 | use LUT4 |
| -0.031 ~ -0.04 | |

DISPLAY DEVICE AND METHOD FOR CORRECTING GAMMA DEVIATION

CROSS-REFERENCE TO RELATED APPLICATION

This application claims priority to and the benefit of Korean Patent Application No. 10-2013-0117364 filed in the Korean Intellectual Property Office on Oct. 1, 2013, the entire contents of which are incorporated herein by reference.

BACKGROUND (a) Technical Field

The present invention relates to a display device and a method for correcting a gamma deviation of the display device.

(b) Description of the Related Art

A display device, such as a liquid crystal display, may form an electric field by applying different electric potentials to a pixel electrode and a common electrode, thereby controlling an arrangement of molecules, e.g., liquid crystal molecules, to control light transmission. Accordingly, images may be displayed.

A liquid crystal display may be produced through several processes, which may include one or more of a thin film transistor (TFT) substrate process, an opposite substrate process, and a liquid crystal layer process. The TFT substrate process may have more influence on picture quality of the liquid crystal display than other processes. The TFT substrate process may include cleaning, deposition, photolithography, etching, stripping, inspection, and repair. A gamma characteristic of the liquid crystal display may be determined according to the TFT substrate process.

During the TFT substrate process, one or more of the cleaning, deposition, photolithography, and etching steps may be substantially non-uniformly performed across a substrate, given limitations of one or more of the related facilities. As a result, picture quality dispersion, such as gamma dispersion, may occur, and picture quality associated with left and right regions of the substrate may be substantially inconsistent with picture quality associated with a center region of the substrate. The above information disclosed in this Background section is for enhancement of understanding of the background of the invention. The Background section may contain information that does not form the prior art that is already known in this country to a person of ordinary skill in the art.

SUMMARY

Embodiments of the present invention may be related to a display device that has desirable picture quality characteristics.

Embodiments of the present invention may be related to a method for correcting a gamma deviation in a display panel. Embodiments of the present invention may be related to a display device that implements the method.

An embodiment of the present invention may be related to a display device that may include a display panel that includes a first region and a second region. The display device may further include a controller that may receive a first gamma value and a second gamma value, use the first gamma value or a third gamma value related to the first gamma value to generate a first image data set, use the first gamma value and the second gamma value to generate a fourth gamma value, and use the fourth gamma value to generate a second image data set. The display device may further include a data driver that may use the first image data set to generate a first data voltage set and use the second image data set to generate a second data voltage set. The first region may use the first data voltage set to display a first portion of an image. The second region may use the second data voltage set to display a second portion of the image.

The controller may calculate a difference value between the first gamma value and the second gamma value. The controller may determine whether the difference value is within a reference range. The controller may calculate an indication value using the difference value and a boundary value of a reference range. The controller may select a first adjustment method based on the indication value. The controller may use the second gamma value and the first adjustment method to generate the fourth gamma value if the difference value is not within the reference range.

The controller may use the first gamma value and a second adjustment method to generate the third gamma value. The controller may use the third gamma value to generate the first image data set. The controller may use the second gamma value and the second adjustment method to generate the fourth gamma value if the difference value is within the reference range.

The controller may determine whether the difference value is within the reference range for a first predetermined grayscale section. The controller may use the second gamma value and the second adjustment method to generate the fourth grayscale value for a second predetermined grayscale section different from the first predetermined grayscale section.

The controller may use the first gamma value to generate the first image data set. The controller may set the fourth gamma value equal to the second gamma value if the difference value is within the reference range.

The controller may determine whether the difference value is within the reference range for a first predetermined grayscale section. The controller may set the fourth gamma value equal to the second gamma value for a second predetermined grayscale section different from the first predetermined grayscale section.

The controller may include a multi-bank memory that may store adjustment methods that include the first adjustment method.

The adjustment methods may respectively correspond to indication value ranges. The indication value may be within a first indication value range among the indication value ranges. The first indication value range may correspond to the first adjustment method.

The display panel may further include a third region. The first region may be located between the second region and the third region. The controller may receive a fifth gamma value. The controller may use the first gamma value and the fifth gamma value to generate a sixth gamma value. The controller may use the sixth gamma value to generate a third image data set. The data driver may use the third image data set to generate a third data voltage set. The third region may use the third data voltage set to display a third portion of the image.

The first region, the second region, and the third regions may be a center region, a left region, and a right region, respectively, of the display panel if the display device is in a standing state of the display device.

An embodiment of the present invention may be related to a method for operating a display device. The display device may include a display panel and a controller. The display panel may include a first region and a second region. The controller may include hardware. The method may include the following steps: receiving a first gamma value and a second gamma value; using the controller and using the first gamma value or a third gamma value related to the first gamma value to generate a first image data set; using the controller and using the first gamma value and the second gamma value to generate a fourth gamma value; using the controller and using the fourth gamma value to generate a second image data set; using the first image data set to generate a first data voltage set; using the second image data set to generate a second data voltage set; using the first region and using the first data voltage set to display a first portion of an image; and using the second region and using the second data voltage set to display a second portion of the image.

The method may include the following steps: calculating a difference value between the first gamma value and the second gamma value; determining whether the difference value is within a reference range; using the difference value and a boundary value of a reference range to calculate an indication value; selecting a first adjustment method based on the indication value; and using the second gamma value and the first adjustment method to generate the fourth gamma value if the difference value is not within the reference range.

The method may include the following steps: using the first gamma value and a second adjustment method to generate the third gamma value; using the third gamma value to generate the first image data set; and using the second gamma value and the second adjustment method to generate the fourth gamma value if the difference value is within the reference range.

The method may include the following steps: determining whether the difference value is within the reference range for a first predetermined grayscale section; and using the second gamma value and the second adjustment method to generate the fourth grayscale value for a second predetermined grayscale section different from the first predetermined grayscale section.

The method may include the following steps: using the first gamma value to generate the first image data set; and setting the fourth gamma value equal to the second gamma value if the difference value is within the reference range.

The method may include the following steps: determining whether the difference value is within the reference range for a first predetermined grayscale section; and setting the fourth gamma value equal to the second gamma value for a second predetermined grayscale section different from the first predetermined grayscale section.

The method may include the following step: storing adjustment methods in a multi-bank memory of the controller. The adjustment methods may include the first adjustment method.

The adjustment methods may respectively correspond to indication value ranges. The indication value may be within a first indication value range among the indication value ranges. The first indication value range may correspond to the first adjustment method.

The method may include the following steps: receiving a fifth gamma value; using the first gamma value and the fifth gamma value to generate a sixth gamma value; using the sixth gamma value to generate a third image data set; using the third image data set to generate a third data voltage set; and using a third region of the display panel and the third data voltage set to display a third portion of the image. The first region is located between the second region and the third region.

The method may include the following steps: storing a first plurality of adjustment methods and a second plurality of adjustment methods in a multi-bank memory of the controller, the first plurality of adjustment methods including a first adjustment method, the second plurality of adjustment methods including a second adjustment method; using the first adjustment method in generating the fourth gamma value; and using the second adjustment method in generating the sixth gamma value.

The method may include the following step: determining the first region, the second region, and the third region for the display panel.

An embodiment of the present invention may be related a display device that may include the following elements: a display panel including a plurality of gate lines, a plurality of data lines, and a plurality of pixels, the display panel being divided into a plurality of regions; a gate driver connected to the plurality of gate lines and configured to apply a gate-on voltage; a data driver connected to the plurality of data lines and configured to apply a data voltage; and a signal controller configured to control the gate driver and the data driver. The signal controller is configured to use different lookup tables (and/or different gamma value adjustment methods) for two or more regions from among the plurality of the region, in which a difference between gamma values of the two or more regions is beyond a reference value or range, in order to make the difference fall within the reference value range.

The signal controller may further include a multi-bank memory configured to store a plurality of lookup tables for one or more regions among the plurality of regions of the display panel.

The plurality of lookup tables may correspond to lookup tables for correcting differences between gamma values of regions in at least one predetermined grayscale section.

The plurality of regions of the display panel may correspond to a center region, a left region, and a right region, and the multi bank memory of the signal controller may store a plurality of lookup tables for each or all of the left region and the right region.

The difference between gamma values of two or more regions may correspond to a difference between a gamma value of the center region and a gamma value of the left region or the right region.

The signal controller may be configured to use a same lookup table (or same adjustment method) for the center and left regions or the center and right regions when the difference between the gamma value of the center region and the gamma value of the left region or the right region is within the reference value or range.

The reference value or range may be defined by about ±0.1.

The lookup table may be gamma related lookup tables or gamma and ACC related lookup tables.

An embodiment of the present invention may be related to a method of correcting a gamma deviation for at least a region of a display panel in a display device. The display device may include the display panel (which may include a plurality of regions) and a signal controller.

The signal controller may include a multi-bank memory storing a plurality of lookup tables (or adjustment methods) for one or more regions among the plurality of regions. The method may include the following steps: measuring a gamma value of a first region of the display panel and a gamma value of a second region; receiving the measured gamma value of the first region and the measured gamma value of the second region; comparing a difference between the gamma value of the first region and the gamma value of the second region with a reference value or range; and when the difference between the gamma values is beyond the reference value or range, selecting a lookup table making the difference fall within the reference value from the multi bank memory and applying the selected lookup table to determine a gamma value for the second region.

The plurality of lookup tables may correspond to lookup tables for correcting differences between gamma values of regions in at least one predetermined grayscale section.

The plurality of regions of the display panel may correspond to a center region, a left region, and a right region. The multi-bank memory of the signal controller may store a plurality of lookup tables for each of the left region and the right region.

The first region may be the center region of the display panel and the second region may be the left region and/or the right region of the display panel.

When the difference between the gamma values is within the reference value or range, a same lookup table may be applied to determine gamma values for the first region and the second region.

The reference value or range may be define by about ±0.1.

The second region may include a plurality of regions.

The method may further include the following steps: after the selecting of the lookup table from the multi bank memory and the applying of the selected lookup table to the second region, measuring the gamma value of the second region; and receiving the measured gamma value of the second region and comparing a difference between the gamma value of the first region and the gamma value of the second region with the reference value or range.

The lookup table may be a gamma related lookup table or a gamma and ACC related lookup table.

The signal controller may include the following elements: a memory unit configured to store received gamma values; a comparator configured to compare the gamma values stored in the memory unit and output a value according to the comparison; and an image processor configured to select a suitable lookup table from the multi band memory according to the output value of the comparator and apply the selected suitable lookup table.

According to embodiments of the present invention, deviations of left and right gamma characteristics may be adjusted and/or minimized Advantageously, satisfactorily uniform picture quality may be provided.

BRIEF DESCRIPTION OF THE DRAWINGS

FIGS. 7 and 8 are diagrams illustrating lookup tables (or adjustment methods) that can be selected according to a gamma deviation according to an embodiment of the present invention.

DETAILED DESCRIPTION OF THE EMBODIMENTS

Embodiments of the present invention will be described in detail with reference to the accompanying drawings. As those skilled in the art would realize, the described embodiments may be modified in various different ways, all without departing from the spirit or scope of the present invention.

Although embodiments of the present invention are described using liquid crystal displays as examples, embodiments of the present invention can be also applied to other types of display devices, such as organic light emitting displays and/or electrophoretic displays.

Although the terms "first", "second", etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer, or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms "first," "second," etc. may also be used herein to differentiate different categories of elements. For conciseness, the terms "first", "second", etc. may represent "first-type (or first-category)", "second-type (or second-category)", etc., respectively.

Various embodiments are described herein below, including methods and techniques. Embodiments of the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

In the description, the term "connect" may mean "electrically connect"; the term "insulate" may mean "electrically insulate".

Figure 1:
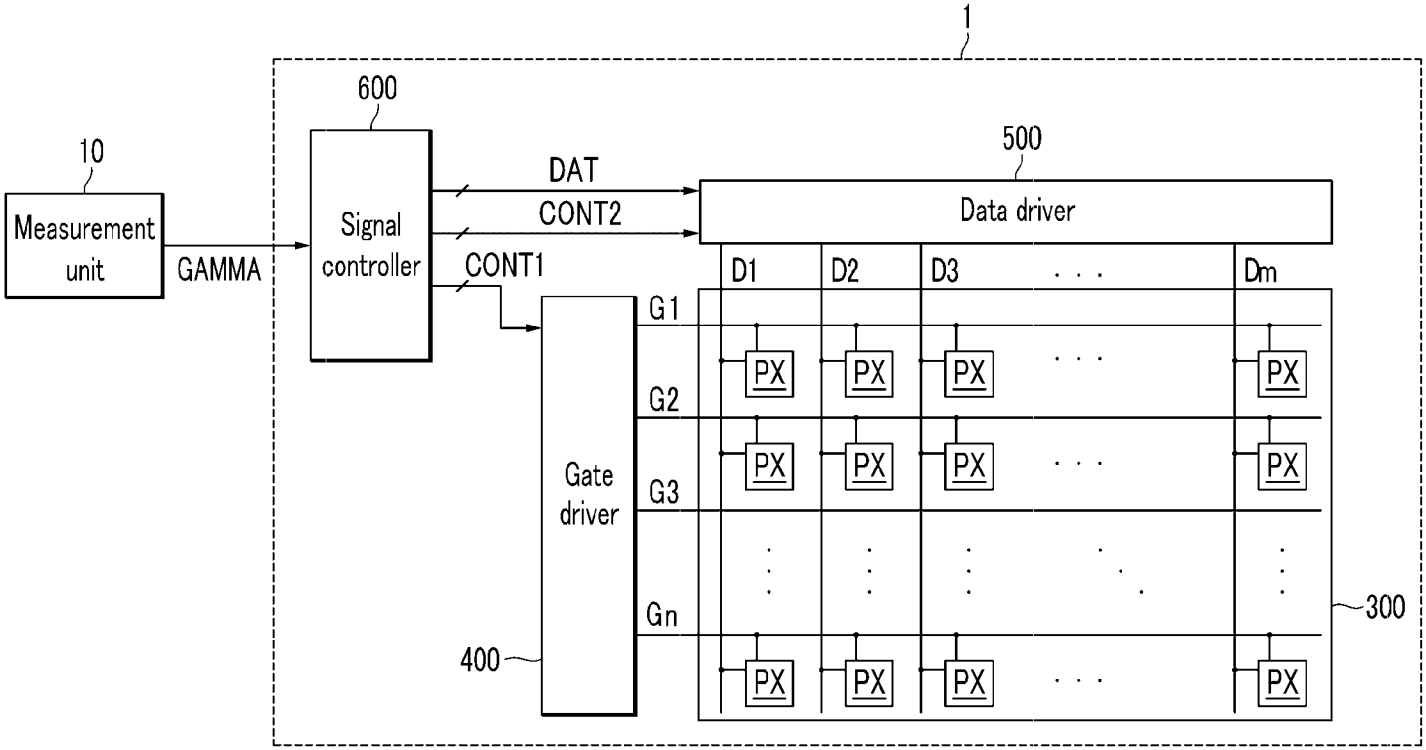
FIG. 1 is a block diagram illustrating a liquid crystal display according to an embodiment of the present invention.
Figure 2:
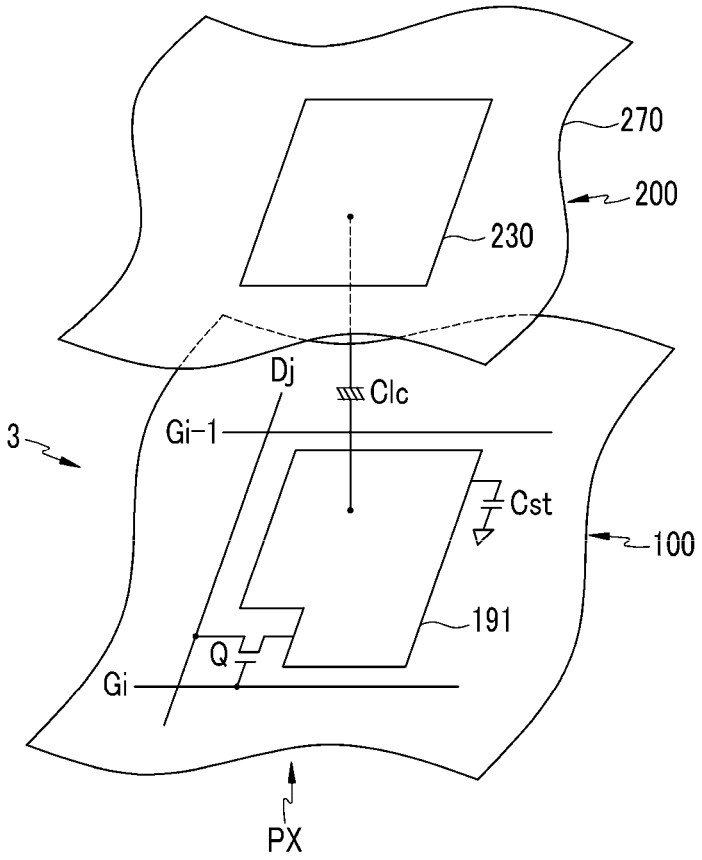
FIG. 2 is an equivalent circuit diagram illustrating one pixel of a liquid crystal display according to an embodiment of the present invention.
Figure 3:
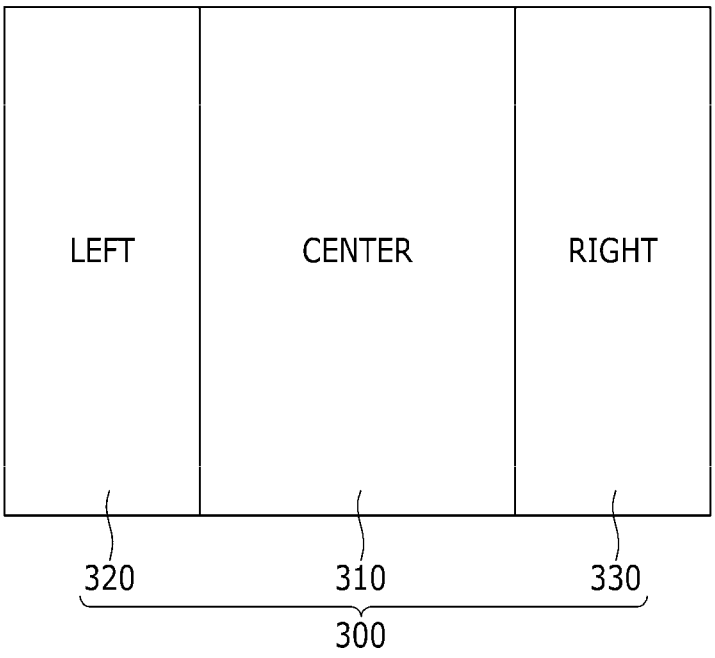
FIG. 3 illustrates regions of a liquid crystal display panel according to an embodiment of the present invention.

FIG. 1 is a block diagram illustrating a liquid crystal display 1 according to an embodiment of the present invention. FIG. 2 is an equivalent circuit diagram illustrating one pixel in the liquid crystal display 1 according to an embodiment of the present invention. FIG. 3 illustrates region division of a liquid crystal display panel 300 of the liquid crystal display 1 according to an embodiment of the present invention.

As illustrated in FIG. 1, the liquid crystal display 1 includes the liquid crystal display panel 300 (configured for displaying an image), a gate driver 400, a data driver 500, and a signal controller 600. FIG. 1 also illustrates a measurement unit 10 located outside the liquid crystal display 1.

The measurement unit 10 may measure luminance of each grayscale of the liquid crystal display panel 300 to calculate gamma values and may provide the calculated gamma values to the signal controller 600 of the liquid crystal display 1. The measurement unit 10 may include a measurement device used for inspecting picture quality, e.g., inspecting one or more of luminance, chromaticity, uniformity, etc., during an outgoing inspection step of the liquid crystal display 1. The measurement unit 10 may include a calculation device for calculating a gamma value based on the luminance measured by the measurement device.

In the specification, the terms "gamma", "gamma value", and "gamma conversion value" may be used interchangeably and may indicate the gamma conversion value unless otherwise defined. For conciseness, the term "gamma value" or "gamma" may be used. Gamma values associated with different liquid crystal display panels may involve deviation. Gamma values associated with one liquid crystal display panel may also involve deviation without sufficient uniformity.

A gamma value (γ) may be calculated from a relationship between a grayscale and luminance. An equation for calculating the gamma value is as follows:

Gamma value= $LOG_{(corresponding\ grayscale/maximum\ grayscale)}$(luminance in corresponding grayscale/luminance in maximum grayscale)

A gamma adjustment refers to adjusting transmittance according to a grayscale for an image to be suitable for a human viewer. A gamma value of 2.2 may be generally considered the most suitable for human eyes.

The liquid crystal display panel 300 includes a lower panel 100, an upper panel 200 that overlaps the lower panel 100, and a liquid crystal layer 3 disposed between the panels 100 and 200. The liquid crystal display panel 300 includes a plurality of gate lines G1-Gn and a plurality of data lines D1-Dm. The plurality of gate lines G1-Gn may extend in a substantially horizontal direction, and the plurality of data lines D1-Dm may cross the plurality of gate lines G1-Gn, may be electrically insulated from the plurality of gate lines G1-Gn, and may extend in a substantially vertical direction.

One of the gate lines G1-Gn and one of the data lines D1-Dm are connected to one pixel PX. The pixels PX are arranged in a matrix form (or a rectangular array). Each of the pixels PX may include a thin film transistor Q, a liquid crystal capacitor Clc, and a sustain (or storage) capacitor Cst. A control terminal of the thin film transistor Q is connected to one of the gate lines G1-Gn, an input terminal of the thin film transistor Q is connected to one of the data lines D1-Dm, and an output terminal of the thin film transistor Q is connected to a pixel electrode 191 that may function as or connect to one terminal of the liquid crystal capacitor Clc and may function as one terminal of the sustain capacitor Cst. The other terminal of the liquid crystal capacitor Clc may be (connected to) a common electrode 270, and the other terminal of the sustain capacitor Cst may receive a sustain voltage. In an embodiment, both the pixel electrode 191 and the common electrode 270 may be located on the lower panel 100.

In some embodiments, the pixels PX in one row may be alternately connected to a pair of gate lines located above or below the one row. A gate line of the gate lines G1-Gn may be alternately connected to the pixels located above and below the one of the gate line. According to such a structure, an odd numbered pixel and an even numbered pixel included in one pixel row may be connected to different gate lines. Each data line of the data lines D1-Dm may be connected to the pixels located along one column.

The signal controller 600 may receive input image signals R, G, and B and control signals from an external graphic controller (not shown). The control signals may include one or more of a vertical synchronization signal (Vsync), a horizontal synchronization signal (Hsync), a main clock signal (MCLK), a data enable signal (DE), etc. The signal controller 600 may process the input image signal to meet an operation condition of the liquid crystal display panel 300 based on the input image signal and the control signal. The signal controller 600 may generate and output image data DAT, a gate control signal CONT1, a data control signal CONT2, and a clock signal.

The gate control signal CONT1 may include a start pulse vertical signal (STV) for indicating a scan start and may include a clock pulse vertical signal (CPV) corresponding to a reference for generation of a gate-on voltage (Von). An output period of the start pulse vertical signal (STV) may match one frame (or a refresh rate). The gate control signal CONT1 may further include an output enable signal (OE) for limiting a duration time of the gate-on voltage (Von).

The data control signal CONT2 may include a start pulse horizontal signal (STH) for indicating a transmission start of the image data DAT for pixels in one row and may include a load signal (TP) for applying corresponding data voltages to the data lines D1-Dm. The data control signal CONT2 may further include a reverse signal (RVS) for reversing a polarity of a data voltage with respect to a common voltage Vcom.

The gate lines G1-Gn of the liquid crystal display panel 300 are connected to the gate driver 400 and may sequentially receive gate-on voltages (Von) according to the gate control signal CONT1 applied from the signal controller 600. Sections which have not received gate-on voltages (Von) may receive gate-off voltages (Voff).

The data lines D1-Dm of the liquid crystal display panel 300 are connected to the data driver 500. The data driver 500 may receive the data control signal CONT2 and the image data DAT from the signal controller 600. The data driver 500 may convert the image data DAT to data voltages using grayscale voltages generated by a grayscale voltage generator (not shown) and may transmit the converted data voltages to the data lines D1-Dm. The data voltages may include a data voltage that has a positive polarity and may include a data voltage that has a negative polarity. Data voltages having the positive polarity and data voltages having the negative polarity may be alternately applied based on a frame, and rows and/or columns of the pixels PX may be reversely driven.

The signal controller 600 may receive gamma values measured for a plurality of regions of the liquid crystal display panel 300 from the external measurement unit 10. The signal controller 600 may generate image data for respective regions using different lookup tables or the same lookup table and using the received gamma values.

The plurality of regions of the liquid crystal display panel 300 may include or may be, for example, three (virtually divided) regions arranged in a horizontal direction, as illustrated in FIG. 3. Among the regions, a region located at a center is referred to as a center region 310, a region located at a left side of the center region 310 is referred to as a left region 320, and a region located at a right side of the center region 310 is referred to as a right region 330.

The three regions may have the same area (or size). The center region may have a relatively larger area, and the left and right regions may have the same area. The three regions may have three different areas. Areas of the regions may be determined in consideration of picture quality uniformity of the liquid crystal display panel, particularly, gamma uniformity, which may depend on a manufacturing process of the liquid crystal display panel 300.

Each of the regions 310, 320, and 330 of the liquid crystal display panel 300 may be determined based on a corresponding picture quality deviation, particularly, a corresponding gamma deviation, which may be equal to or larger than a predetermined value when an image is displayed. For example, when the same grayscale voltage is applied, luminance of the left region 320 may be substantially higher or lower than a reference luminance, such that the luminance deviation associated with the luminance of the left region 320 may be larger than the luminance deviation associated with the luminance of the center region 310. The luminance deviation, which is related to gamma deviation, may occur during a manufacturing process of the liquid crystal display panel 300. In an embodiment, the left region 320 may display an image using a lookup table different from a lookup table used for the center region 310, for reducing the gamma deviation.

In some embodiments, the liquid crystal display panel 300 may be virtually divided to include regions arranged in a vertical direction. In some embodiments, the liquid crystal display panel may be divided into nine regions, such as left, center, and right regions arranged in the horizontal direction, and top, center, and bottom regions arranged in the vertical direction. The liquid crystal display panel may be virtually divided into more departmentalized regions in the horizontal direction and/or the vertical direction in consideration of a size of the liquid crystal display panel.

Figure 4:
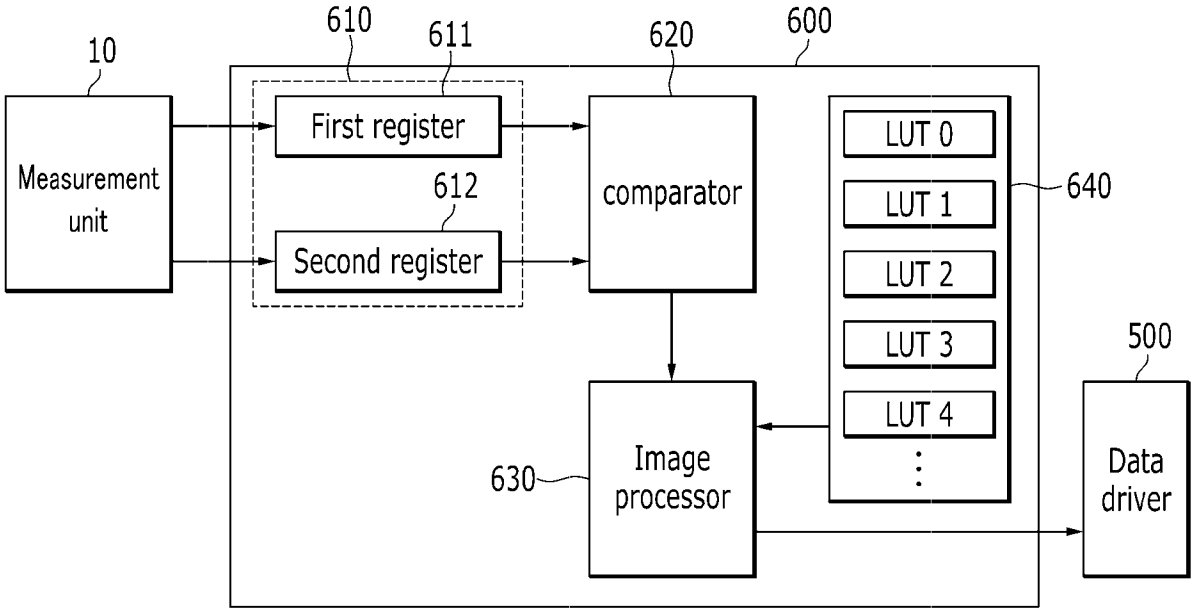
FIG. 4 is a block diagram schematically illustrating a structure of a signal controller of a liquid crystal display according to an embodiment of the present invention.

FIG. 4 is a block diagram schematically illustrating a structure of the signal controller 600 of the liquid crystal display 1 according to an embodiment of the present invention. The signal controller 600 may be used for correcting a gamma deviation of each region of the liquid crystal display 1, e.g., the left, center, and right regions illustrated in FIG. 3. Correction of the gamma deviation of the left region against the center region is discussed as an example.

The signal controller 600 includes a first memory 610, a comparator 620, an image processor 630, and a second memory 640. The first memory 610 includes a first register 611 and a second register 612. The second memory 640 may include memory banks that store a plurality of lookup tables, e.g., LUT 0, LUT 1, LUT 2, LUT 3, LUT 4, etc. The signal controller 600 may receive a signal from the measurement unit 10 located outside the liquid crystal display and may provide image data and a data control signal to the data driver 500 of the liquid crystal display 1.

The lookup tables may be configured in consideration of a picture quality dispersion characteristic of the liquid crystal display panel 300. The lookup tables may be color correction lookup tables for an accurate color control (ACC) to accurately control three colors RGB or may be gamma correction lookup tables configured to be applied before use of color correction lookup tables. The plurality of lookup tables may be configured differently over all grayscales associated with the liquid crystal display panel 300 or may be configured differently for only a predetermined grayscale section, such as a low grayscale section, an intermediate grayscale section, or a high grayscale section among the grayscales.

By default, the liquid crystal display panel 300 may be controlled using the lookup table LUT 0 optimized for the center region 310. The measurement unit 10 may measure luminance values for all the grayscales at a center of the liquid crystal display panel 300 corresponding to a center of the center region 310, may calculates a gamma value using a relation between luminance values and grayscales, and may transmit the gamma value to the signal controller 600. The signal controller 600, having received the gamma value of the center region 310, may store the received gamma value in the first register 611.

The measurement unit 10 may measure luminance values for all the grayscales at a particular position of the left region 320 of the liquid crystal display panel 300, may calculate a gamma value, and may transmit the gamma value to the signal controller 600. The signal controller 600, having received the gamma value of the left region 320, may store the gamma value of the left region 320 in the second register 612. The particular position of the left region 320, at which the luminance is measured, may correspond to a position that can represent the gamma value of the left region 320 and may be determined in consideration of the size of the liquid crystal display panel 300. For example, in a 40-inch liquid crystal display panel, the particular position may be a position that is 10 cm apart from a left edge of the left region 320 in a horizontal direction and is located at a center between an upper edge and a lower edge of the left region 320 in a vertical direction.

The comparator 620 of the signal controller 600 may calculate a difference between the gamma values stored in the two registers 611 and 612 of the first memory 610 and may compare the difference with a preset reference value or range. The reference value or range may be or may represent an acceptable limit on the gamma value deviation of the left region 320 with respect to the center region 310. The reference value or range may be determined based on gamma uniformity of the liquid crystal display panel 300 and/or based on a need of a user of the liquid crystal display 1. In an embodiment, the reference value or range may be, for example, a range defined by ±0.1, such that if a value generated by subtracting the gamma value of the left region 320 from the gamma value of the center region 310 is within the range defined by ±0.1, the deviation may be acceptable.

The comparator 620 may compare the difference between the gamma values with the reference value or range, and may subsequently transmit a comparison result indicating whether the difference between the gamma values is within or beyond the reference value or range to the image processor 630. If the difference between the gamma values is beyond the reference value or range, the comparator 620 may transmit a value indicating by how much the difference is beyond the reference value or range. In an embodiment, the reference value or range is defined by ±0.1, and if the difference between the gamma values is −0.12, the comparator 620 may transmit a value −0.02 indicating that the difference between the gamma values is beyond a lowest limit of −0.1 of the reference value by −0.02.

If the comparison result received from the comparator 620 indicates that the difference between the gamma values is within the reference value or range, the image processor 630 may process an image signal for the left region 320 using the default lookup table LUT 0 optimized for the center region 310. That is, since the gamma deviation of the left region 320 is within an acceptable range, the same lookup table may be used for both the center region 310 and the left region 320.

If the comparison result received from the comparator 620 indicates that the difference between the gamma values is beyond the reference value or range, the image processor 630 may select a suitable lookup table based on the excess amount by which the difference between the gamma values is beyond the reference value or range. The suitable lookup table may be selected from the plurality of lookup tables LUT 1, LUT 2, LUT 3, LUT 4, etc. stored in respective memory banks of the second memory 640. The image processor 630 may use the selected suitable lookup table to process the image signal for the left region 320. For example, if the difference between the gamma values is −0.12 such that it is beyond the reference range lower limit −0.1 by 0.02, the image processor 630 may select a lookup table that can reduce the gamma value of the left region 320 by 0.02 or slightly more in order to make the difference between the gamma values −0.1 or smaller.

Analogously, a gamma deviation of the right region 330 with respect to the center region 310 may also be corrected.

In an embodiment, the signal controller 600 may receive the gamma value of the center region 310 and the gamma value of the left region 320 from the measurement unit 10 and may compare the received gamma values. The signal controller 600 may apply a lookup table different from a lookup table optimized for the center region 310 to process the image signal for the left region 320 if the difference between the gamma values is beyond the reference value or range. Through applying suitable lookup tables, the display panel 300 may minimize gamma deviations, which may be generated during a liquid crystal display panel manufacturing process. Advantageously, substantially uniform, satisfactory picture quality may be provided.

Analogously, a gamma deviation of the right region 330 with respect to the center region 310 may also be corrected.

In an embodiment, for correcting a gamma deviation of the right region 330, since the gamma value of the center region 310 is already stored in the first register 611 of the signal controller 600 (e.g., for correcting the gamma deviation of the left region 320), the gamma value of the center region 310 does not to be further measured, and the gamma value of the right region 330 is measured and stored in the second register 612. In a 40-inch liquid crystal display panel, a position where the gamma value of the right region 330 is measured may be a position that is 10 cm apart from a right edge of the right region 330 in the horizontal direction and is located at a center between an upper edge and a lower edge of the right region 330 in the vertical direction.

The comparator 620 of the signal controller 600 may calculate a difference between the gamma values stored in the first memory 610, may compare the difference with a reference value or range to generate a comparison result, and may transmits the comparison result to the image processor 630. If the difference between the gamma values is within the reference value or range, the gamma value of the right region 330 may not need to be corrected, and the image processor 630 may generate image data for the right region 330 using the default lookup table LUT 0.

If the difference between the gamma values is beyond the reference value or range, the image processor 630 may select a suitable lookup table based on the excess amount by which the difference is beyond the reference value or range. The suitable lookup table may be one of the lookup tables LUT 1, LUT2, LUT3, LUT 4, etc. stored in the second memory 640. The image processor 630 may use the selected suitable lookup table to generate image data for the right region 330. Accordingly, the display panel 300 may reduce the gamma deviations of the left and right regions with respect to the center region to be within the reference value or range.

According to an embodiment, the signal controller 600 may receive all of the gamma value of the center region, the gamma value of the left region, and the gamma value of the right region, may store all the gamma values in the first memory 610, and may then correct the gamma deviations of the left region and the right region.

Figure 5:
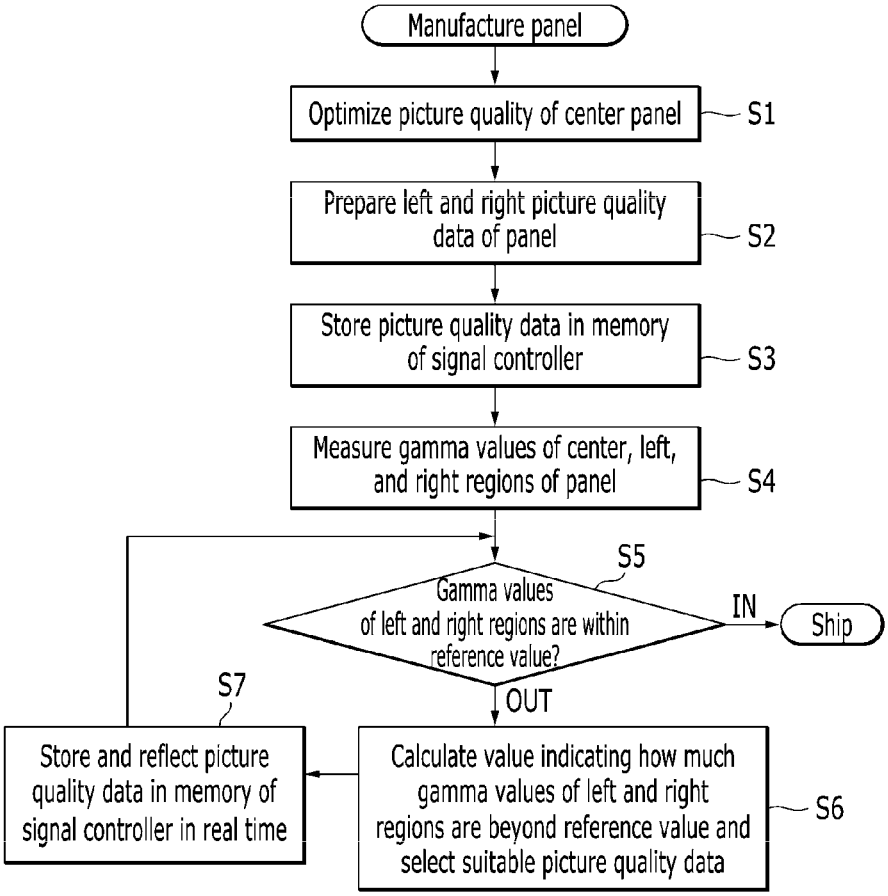
FIG. 5 is a flowchart illustrating a method for processing a liquid crystal display panel (after manufacturing of the liquid crystal display panel) according to an embodiment of the present invention.

FIG. 5 is a flowchart illustrating a method for processing a liquid crystal display panel (e.g., the liquid crystal display panel 300) according to an embodiment of the present invention. The method may be performed after a step (or process) of manufacturing the liquid crystal display panel. The method may include a step of correcting gamma deviations of left and right regions of the liquid crystal display panel and may include one or more steps and/or processes discussed above with reference to FIG. 4. The method may be performed using a device (e.g., a computer) that includes hardware elements.

The method may include step S1, optimizing picture quality data for a center region of the liquid crystal display panel. The optimization of the picture quality data for the center region may involve configuring a lookup table (e.g., LUT 0 discussed with reference to FIG. 4) that may be used for generating image data for the center region with satisfactory quality. In an embodiment, the lookup table may be configured based on a gamma value of 2.2, which may be optimal for typical human eyes.

In step S2, based on the picture quality data optimized for the center region, a plurality of picture quality data sets for other regions, e.g., the left region and the right region, of the liquid crystal display panel may be prepared. The picture quality data sets may be prepared based on the gamma value deviations for respective regions and based on respective grayscales shown in manufactured liquid crystal display panels. The picture quality data sets may be represented by lookup tables (e.g., LUT 1, LUT 2, etc. discussed with reference to FIG. 4). In step S3, the picture quality data sets may be stored in a multi-bank memory of a signal controller (e.g., the second memory 640 of the signal controller 600 discussed with reference to FIG. 4), which may include hardware elements.

In step S4, gamma values of the center, left, and right regions of the liquid crystal display panel may be measured.

In step S5, whether (deviations of) the gamma values of the left and right regions with respect to the gamma value of the center region are within a reference value or range may be determined. The measured gamma values of the center, left, and right regions of the liquid crystal display panel may be stored in three registers of the signal processor, respectively. If (the deviations of) the gamma values of the left and right regions are within the reference value or range, the picture quality uniformity of the liquid crystal display panel may be deemed acceptable (indicated by "IN" in FIG. 5). Therefore, the same picture quality data (e.g., the lookup table LUT 0) may be used for each of the center, left, and right regions. Subsequently, the liquid crystal display panel may be shipped for producing a liquid crystal display device.

If either of (the deviations of) the gamma values of the left and right regions is beyond the reference value or range and is unacceptable (indicated by "OUT" in FIG. 5), in step S6, for each of left and right regions with an acceptable gamma value, an excess value indicating how much the unacceptable gamma value is beyond the reference value or range is calculated, and a picture quality data set (i.e., lookup table) suitable for correcting the gamma value is selected from the multi bank memory. In step S7, the selected picture quality data set(s) may be stored in the memory of the signal controller in real time, and the gamma value(s) of the left region and/or the right regions may be adjusted using the corresponding selected picture quality data set(s). Subsequently, in step S5, a verification process of determining whether (deviations of) the gamma values of the left and right regions are within the reference value or range is performed. If the gamma values are within the reference value or range, the liquid crystal display panel is deemed acceptable. If either of (the deviations of) the gamma values is beyond the reference value or range, step S6 and step S7 may be further performed.

Figure 6:
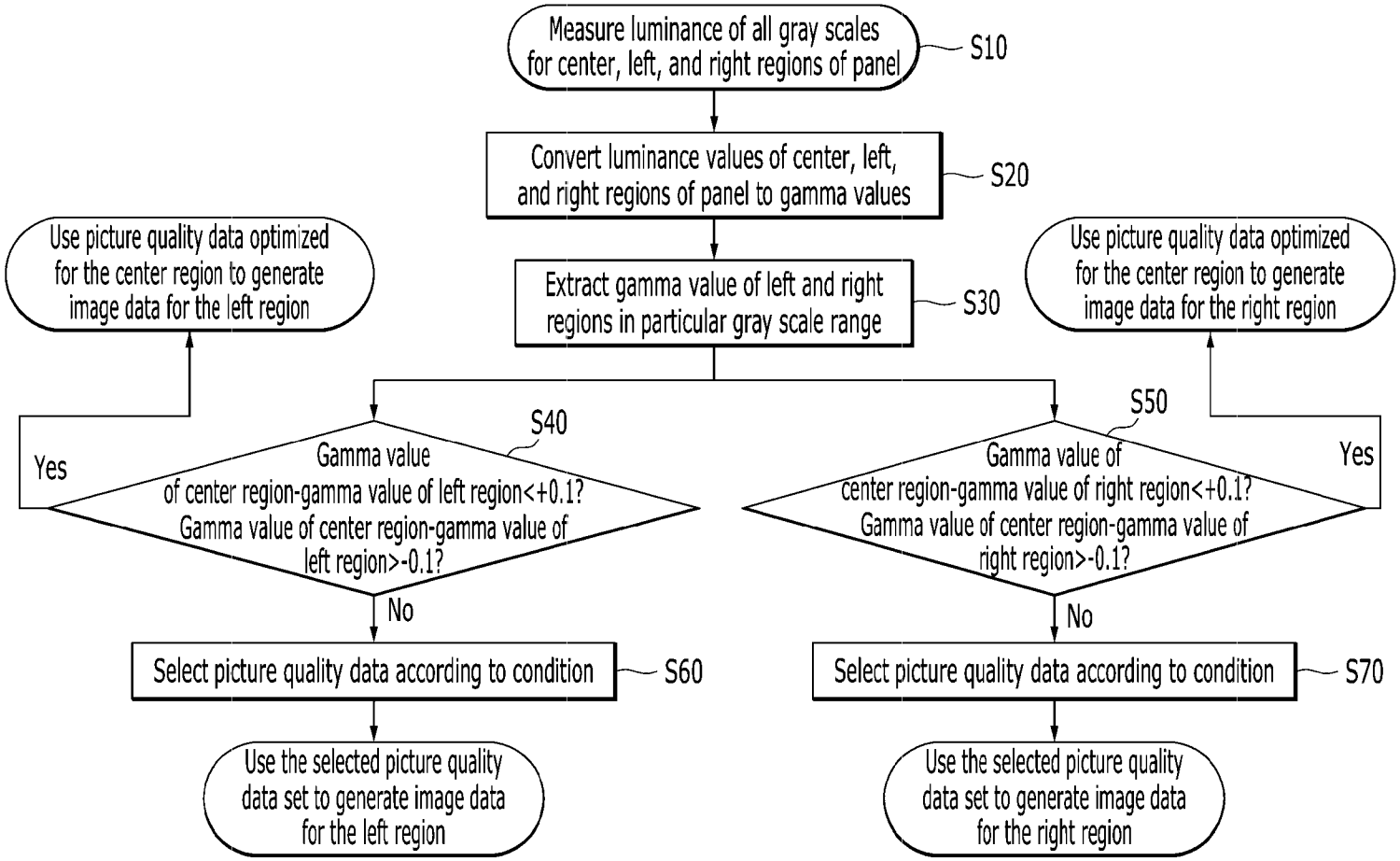
FIG. 6 is a flowchart illustrating a method for correcting a gamma deviation according to an embodiment of the present invention.

FIG. 6 is a flowchart illustrating a method for correcting a gamma deviation according to an embodiment of the present invention. Steps before step S40 illustrated in FIG. 6 may be performed outside the liquid crystal display panel (e.g., performed by the measurement unit 10 illustrated in FIG. 4 and/or other devices) and may be related to step S4 discussed with reference to FIG. 5. Steps from step S40 illustrated in FIG. 6 may be performed by the signal controller of the liquid crystal display panel and may be related to steps S5 and S6 discussed with reference to FIG. 5.

The method may include step S10, measuring luminance values for all the grayscales associated with the liquid crystal display panel for each of the center, left, and right regions of the display panel. In step S20, the measured luminance value for each region may be converted to a gamma value using a known grayscale-luminance relationship equation.

Deviations of the gamma values of the left and right regions with respect to the gamma value of the center region may exist over all the grayscales. The deviations in some grayscale sections may be acceptable and may be disregarded. The deviations in some grayscale sections may be unacceptably large according to a panel manufacturing process. In an embodiment, the deviations of the gamma values in some grayscale sections or ranges, for example, a section from grayscale 20 to grayscale 128, may be considered as particularly significant. In step S30, the gamma value in a particular grayscale section or range may be extracted for each of the left and right regions. Subsequently, deviations of the gamma values, if any, may be calculated.

In step 40, the signal controller, having received the gamma value for each region, may calculate deviation of the gamma value of the left region with respect to the gamma value of the center region and may determine whether the deviation is within a reference value or range, for example, a range defined by ±0.1. The calculation and determination of the deviation may be performed for the entire extracted grayscale section or all the extracted grayscale sections or may be performed for one or more selected or predetermined grayscale sub-sections or sections among the extracted grayscale sections. In an embodiment, in the extracted grayscale section from grayscale 20 to grayscale 128, a section from grayscale 20 to grayscale 60 and a section from grayscale 100 to grayscale 140 may be selected for determination of deviation(s). The signal controller may determine whether the gamma value of the center region minus the gamma value of the left region) is within the range of −0.1 to +0.1 for the selected grayscale sections.

If a reference condition is satisfied, e.g., if the gamma value of the center region minus the gamma value of the left region) is within the range of −0.1 to +0.1 for the selected grayscale sections, the signal controller may use the gamma value of the left region (without adjustment) to generate image data for the left region, and/or the signal controller may use a picture quality data set (e.g., a lookup table or adjustment method/formula) optimized for the center region to generate image data for the left region.

If the signal controller determines that the deviation of the gamma value deviation is beyond the reference value or range in step S40, the signal controller may perform step S60. In step S60, the signal controller may select a suitable picture quality data set (e.g., a suitable lookup table) from the multi-bank memory of the signal controller according to an indication value (or excess value) that indicates how much the deviation is beyond the reference value or range. The signal controller may use the selected picture quality data set (for adjusting and/or generating a left-region gamma value) to generate image data for the left region.

In step S50, the signal controller may calculate the deviation of the gamma value of the right region with respect to the center region is calculated and may determine whether the deviation is within the reference value or range. If the deviation is within the reference value or range, the signal controller may use the gamma value of the right region (without adjustment) to generate image data for the right region, and/or the signal controller may use the picture quality data set (e.g., the lookup table or adjustment method/formula) optimized for the center region to generate image data for the right region.

If the signal controller determines that the deviation of the gamma value deviation is beyond the reference value or range in step S50, the signal controller may perform step S70. In step S70, the signal controller may select a suitable picture quality data set (e.g., a suitable lookup table) from the multi-bank memory of the signal controller according to an indication value (or excess value) that indicates how much the deviation is beyond the reference value or range. The signal controller may use the selected picture quality data set (for adjusting and/or generating a right-region gamma value) to generate image data for the right region.

Figure 8:
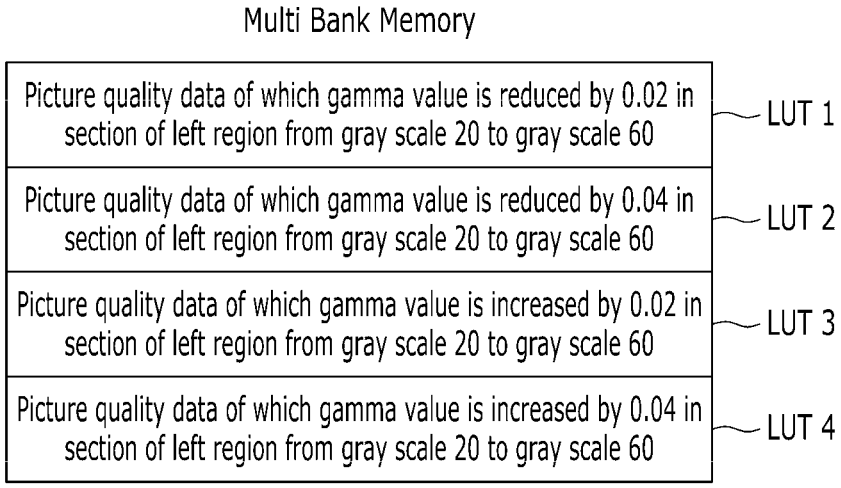

FIG. 7 is a diagram illustrating lookup table selection rules (or adjustment method/formula selection rules) according to an embodiment of the present invention. FIG. 8 is a diagram illustrating lookup tables (adjustment methods/formulas) that can be selected according to an indication value that indicates how much the gamma deviation of the left region with respect to the center region of the liquid crystal display panel is beyond the reference value according to an embodiment of the present invention.

For example, the gamma value of the left region may be 2.32, and the gamma value of the center region may be 2.2, such that, in step S40 of FIG. 6, the gamma value of the center region minus the gamma value of the left region may be equal to −0.12, which is less than −0.1. The indication value may be 0.02, calculated from subtracting −0.12 from −0.1, i.e., (−0.1)−(−0.12)=0.02. According to the lookup table selection rules illustrated in FIG. 7, the lookup table LUT1 may be selected for processing to gamma value for the left region. According to the lookup table LUT1 illustrated in FIG. 8, the signal controller may reduce the gamma value of the left region by 0.02, such that the gamma value for the left region may become 2.32−0.02=2.30. The signal controller may use the gamma value 2.30 for generating image data for the left region for the selected grayscale section of grayscale 20 to grayscale 60.

As another example, if the indication value is −0.03, the lookup table LUT4 should be selected. If the indication value is −0.03 and if the lookup table LUT3, which increases the gamma value by 0.02, were applied, the deviation of the gamma value would still be beyond the reference value; therefore the lookup table LUT4 should be selected if the indication value is −0.03.

In the examples illustrated in FIGS. 7 and 8, the indication value granularity (or excess value granularity) for configuring lookup tables is 0.02. In embodiments of the invention, the finer the indication value granularity is, the more the lookup tables are required.

In an embodiment, in addition to lookup tables implemented for the grayscale section from grayscale 20 to grayscale 60, lookup tables for one or more other grayscale sections may be implemented. In an embodiment, in addition to or alternative to lookup tables implemented for the left region and/or lookup tables implemented for both the left region and the right region, lookup tables for the right region may be implemented. The lookup tables may be stored in the multi-bank memory of the signal controller and may be used for correcting grayscale deviation(s).

While this invention has been described in connection with what is presently considered to be practical embodiments, it is to be understood that the invention is not limited to the disclosed embodiments. The invention is intended to cover various modifications and equivalent arrangements included within the spirit and scope of the appended claims.

What is claimed is:

1. A display device comprising:

a display panel including a first region and a second region;

a controller configured to receive a first gamma value and a second gamma value, configured to use the first gamma value or a third gamma value related to the first gamma value to generate a first image data set, configured to use the first gamma value and the second gamma value to generate a fourth gamma value, and configured to use the fourth gamma value to generate a second image data set; and a data driver configured to use the first image data set to generate a first data voltage set and configured to use the second image data set to generate a second data voltage set, wherein the first region is configured to use the first data voltage set to display a first portion of an image, and wherein the second region is configured to use the second data voltage set to display a second portion of the image.

2. The display device of claim 1, wherein the controller is configured to calculate a difference value between the first gamma value and the second gamma value, wherein the controller is configured to determine whether the difference value is within a reference range, and wherein the controller is configured to calculate an indication value using the difference value and a boundary value of a reference range, configured to select a first adjustment method based on the indication value, and configured to use the second gamma value and the first adjustment method to generate the fourth gamma value if the difference value is not within the reference range.

3. The display device of claim 2, wherein the controller is configured to use the first gamma value and a second adjustment method to generate the third gamma value, wherein the controller is configured to use the third gamma value to generate the first image data set, and wherein the controller is configured to use the second gamma value and the second adjustment method to generate the fourth gamma value if the difference value is within the reference range.

4. The display device of claim 3, wherein the controller is configured to determine whether the difference value is within the reference range for a first predetermined grayscale section, and wherein the controller is configured to use the second gamma value and the second adjustment method to generate the fourth grayscale value for a second predetermined grayscale section different from the first predetermined grayscale section.

5. The display device of claim 2, wherein the controller is configured to use the first gamma value to generate the first image data set, and wherein the controller is configured to set the fourth gamma value equal to the second gamma value if the difference value is within the reference range.

6. The display device of claim 5, wherein the controller is configured to determine whether the difference value is within the reference range for a first predetermined grayscale section, and wherein the controller is configured to set the fourth gamma value equal to the second gamma value for a second predetermined grayscale section different from the first predetermined grayscale section.

7. The display device of claim 2, wherein the controller includes a multi-bank memory configured to store adjustment methods that include the first adjustment method.

8. The display device of claim 7, wherein the adjustment methods respectively correspond to indication value ranges, wherein the indication value is within a first indication value range among the indication value ranges, and wherein the first indication value range corresponds to the first adjustment method.

9. The display device of claim 1, wherein the display panel further includes a third region, wherein the first region is located between the second region and the third region, wherein the controller is further configured to receive a fifth gamma value, configured to use the first gamma value and the fifth gamma value to generate a sixth gamma value, and configured to use the sixth gamma value to generate a third image data set, wherein the data driver is further configured to use the third image data set to generate a third data voltage set, and wherein the third region is configured to use the third data voltage set to display a third portion of the image.

10. The display device of claim 9, wherein the first region, the second region, and the third regions are a center region, a left region, and a right region, respectively, if the display device is in a standing state of the display device.

11. A method for operating a display device, the display device comprising a display panel and a controller, the display panel comprising a first region and a second region, the controller comprising hardware, the method comprising:

receiving a first gamma value and a second gamma value;

using the controller and using the first gamma value or a third gamma value related to the first gamma value to generate a first image data set;

using the controller and using the first gamma value and the second gamma value to generate a fourth gamma value;

using the controller and using the fourth gamma value to generate a second image data set;

using the first image data set to generate a first data voltage set;

using the second image data set to generate a second data voltage set;

using the first region and using the first data voltage set to display a first portion of an image; and using the second region and using the second data voltage set to display a second portion of the image.

12. The method of claim 11, further comprising:

calculating a difference value between the first gamma value and the second gamma value;

determining whether the difference value is within a reference range;

using the difference value and a boundary value of a reference range to calculate an indication value;

selecting a first adjustment method based on the indication value; and using the second gamma value and the first adjustment method to generate the fourth gamma value if the difference value is not within the reference range.

13. The method of claim 12, further comprising:

using the first gamma value and a second adjustment method to generate the third gamma value;

using the third gamma value to generate the first image data set; and using the second gamma value and the second adjustment method to generate the fourth gamma value if the difference value is within the reference range.

14. The method of claim 13, further comprising:

determining whether the difference value is within the reference range for a first predetermined grayscale section; and using the second gamma value and the second adjustment method to generate the fourth grayscale value for a second predetermined grayscale section different from the first predetermined grayscale section.

15. The method of claim 12, further comprising:

using the first gamma value to generate the first image data set; and setting the fourth gamma value equal to the second gamma value if the difference value is within the reference range.

16. The method of claim 15, further comprising:

determining whether the difference value is within the reference range for a first predetermined grayscale section; and setting the fourth gamma value equal to the second gamma value for a second predetermined grayscale section different from the first predetermined grayscale section.

17. The method of claim 12, further comprising: storing adjustment methods in a multi-bank memory of the controller, wherein the adjustment methods include the first adjustment method.

18. The method of claim 17, wherein the adjustment methods respectively correspond to indication value ranges, wherein the indication value is within a first indication value range among the indication value ranges, and wherein the first indication value range corresponds to the first adjustment method.

19. The method of claim 11, further comprising:

receiving a fifth gamma value;

using the first gamma value and the fifth gamma value to generate a sixth gamma value;

using the sixth gamma value to generate a third image data set;

using the third image data set to generate a third data voltage set; and using a third region of the display panel and the third data voltage set to display a third portion of the image, wherein the first region is located between the second region and the third region.

20. The method of claim 19, further comprising:

storing a first plurality of adjustment methods and a second plurality of adjustment methods in a multi-bank memory of the controller, the first plurality of adjustment methods including a first adjustment method, the second plurality of adjustment methods including a second adjustment method;

using the first adjustment method in generating the fourth gamma value; and using the second adjustment method in generating the sixth gamma value.

* * * * *